US007263308B2

(12) United States Patent
Harada et al.

(10) Patent No.: US 7,263,308 B2
(45) Date of Patent: Aug. 28, 2007

(54) CLEANING MEMBER, CLEANING DEVICE, CHARGING DEVICE, TRANSFER DEVICE, PROCESS CARTRIDGE, AND IMAGE FORMING APPARATUS

(75) Inventors: Hirohmi Harada, Kanagawa (JP); Takaya Muraishi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 32 days.

(21) Appl. No.: 10/912,117

(22) Filed: Aug. 6, 2004

(65) Prior Publication Data

US 2005/0063728 A1 Mar. 24, 2005

(30) Foreign Application Priority Data

Aug. 7, 2003 (JP) ..... 2003-288955
Jul. 8, 2004 (JP) ..... 2004-202005

(51) Int. Cl.
*G03G 15/02* (2006.01)

(52) U.S. Cl. ..... 399/100; 399/343; 399/357

(58) Field of Classification Search ..... 399/100, 399/343, 357
See application file for complete search history.

(56) References Cited

U.S. PATENT DOCUMENTS 5,194,050 A 3/1993 Muraishi et al.
5,594,539 A 1/1997 Murano et al.
5,799,229 A 8/1998 Yokoyama et al.
5,878,317 A 3/1999 Masuda et al.
5,946,529 A 8/1999 Sato et al.
6,088,551 A 7/2000 Satoh et al.
6,327,055 B1 * 12/2001 Nobe ..... 399/53
6,628,912 B2 9/2003 Amemiya et al.
2002/0163105 A1 * 11/2002 Kosaka et al. ..... 264/321
2003/0039483 A1 2/2003 Funabashi
2003/0123905 A1 7/2003 Suda et al.
2004/0126134 A1 7/2004 Harada et al.
2005/0009940 A1 * 1/2005 Goldstein et al. ..... 521/128

FOREIGN PATENT DOCUMENTS

JP 2002-221874 8/2002
JP 2003-66807 3/2003

* cited by examiner

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A cleaning member includes a contact portion that is in contact with a cleaning target, at least the contact portion is made of melamine resin foam that is obtained by heating and compressing an original form. Because the heated and compressed melamine resin foam is used, the wearing out of the cleaning target member is extremely less, and the cleaning capability is maintained at an adequate state for a long period of time.

24 Claims, 7 Drawing Sheets

CLEANING MEMBER, CLEANING DEVICE, CHARGING DEVICE, TRANSFER DEVICE, PROCESS CARTRIDGE, AND IMAGE FORMING APPARATUS

CROSS-REFERENCE TO RELATED APPLICATIONS

The present document incorporates by reference the entire contents of Japanese priority documents, 2003-288955 filed in Japan on Aug. 7, 2003 and 2004-202005 filed in Japan on Jul. 8, 2004.

BACKGROUND OF THE INVENTION

1) Field of the Invention

The present invention relates to an image forming apparatus such as a printer, a copying machine, a facsimile, and a plotter. More specifically, this invention relates to a cleaning member used in the image forming apparatus, a cleaning device using the cleaning member, and a charging device, a transfer device, a process cartridge, and the image forming apparatus each including the cleaning device.

2) Description of the Related Art

Image forming apparatuses such as printers, copying machines, facsimiles, plotters, and those using electro-photography to form images, are widely used. Such an image forming apparatus forms images in the following manner. The image forming apparatus includes an image carrier that is an electro-photographic photosensitive element (photoconductive element). A charging device charges the image carrier, and an optical write operation is performed on the charged image carrier, to form an electrostatic latent image thereon. A developing device develops the electrostatic latent image with a developer, to visualize as a visible image. A transfer unit, directly or through an intermediate transfer element, transfers the visible image on the image carrier to a transfer material. The visible image on the transfer material is fixed to form an image thereon.

Attempts are being made to increase the life of the electro photographic image forming apparatuses. To achieve this goal, it is attempted to prevent reduction in film thickness of the image carrier, which is disposed at a central position of the image forming apparatus, and to prevent soiling of the charging device and the transfer unit, to thereby ensure excellent image formation over a longer duration. Consequently, running costs largely reduce.

It is known that the charging device largely affects the reduction in film thickness of the image carrier. There are various types of charging devices such as contact charging, and "micro-gap" charging (proximity charging) that uses a micro-space formed for charging. These charging devices may be constructed as a charge roller made of an elastic material with its resistance adjusted in the following manner. The charge roller is provided in contact with or close to the image carrier, and applies charging bias to the image carrier while the charge roller is made to rotate along with the image carrier. In such case, an alternating current (ac) voltage is superimposed on a direct current (dc) voltage, and the superimposed voltages are applied as the charging bias. The ac voltage has a peak-to-peak voltage twice as high as that of a discharge start voltage of the dc voltage. Application of the ac voltage causes the potential on the surface of the image carrier to converge to a value of the dc voltage applied, which allows uniform charging over the surface of the image carrier.

However, the contact charging or the proximity charging is carried out by charging the surface of the image carrier by pulsed discharge generated in a micro-space between the image carrier and the charge roller. Therefore, the surface of the image carrier is etched all the time. Consequently, there is a further reduction in film thickness of the image carrier.

Some new charging methods as follows are proposed, to suppress the reduction in film thickness of the image carrier.

(1) DC Charging (Method of applying only a dc voltage to a contact type charge roller):

In this method, the surface of the image carrier is charged only with the dc voltage. Because the ac voltage is not applied thereto, the amount of current flowing in the image carrier is extremely small. In other words, pulsed discharge to the image carrier also decreases. Consequently, the etching of the image carrier (photosensitive element) reduces, and the reduction in film thickness of the image carrier is less.

(2) Coating of Lubricant to Image Carrier:

A lubricant layer is formed on the image carrier using a cleaning device for the image carrier, or a solid lubricant coating device provided as a discrete unit, and the reduction in film thickness of the image carrier is suppressed. Zinc stearate is a typical solid lubricant.

However, these charging methods have the following two problems:

(1) In the dc charging, soil (flying toner upon transfer, paper dust, and the like) is easily deposited on the surface of the charge roller. Therefore, electrical resistance and the state of the surface change, thereby inhibiting uniform charging. The reason is that, because the ac voltage is not applied, even a slight fluctuation in resistance results in a soiled image and nonuniform density.

(2) When the solid lubricant is coated on the image carrier, cleaning capability is very stable even under environmental fluctuations of the image carrier. This is because a frictional coefficient with the cleaning unit, typified by a cleaning blade, is low and stable. However, the low frictional coefficient increases the amount of toner particles, which are escaping through the blade little by little (toner particles passing through the blade). In other words, by making life of the image carrier longer, the toner particles escaping from the cleaning device increase, which further soils the charging device.

Many imaging units of the image forming apparatuses in recent years are configured to have a process cartridge because of easy replacement and maintenance. However, because the process cartridge includes the image carrier and the devices around the image carrier integrated into one unit, improvement in life of the image carrier only does not necessarily lead to improvement in life of the process cartridge.

In other words, some measures are required to improve the life of not only the image carrier, but also the devices around the image carrier.

Furthermore, image forming apparatuses such as printers and copying machines that employ polymer toner are available in the market due to demand for higher image quality. However, the polymer toner is generally difficult to clean, and therefore, it is more difficult to achieve the increase in life of the devices than in case of the conventional pulverized toner.

Japanese Patent Application Laid Open No. 2002-221874 and Japanese Patent Application Laid Open No. 2003-66807 disclose technologies in which, melamine resin foam that is made of melamine foam is used as a cleaning member, to remove residual toner on the transfer member and the paper dust. Therefore, it is described that using the melamine resin foam is an excellent method to increase the life of the devices.

The melamine foam has a three-dimensional mesh structure in which cells of some tens to hundreds of micrometers are linked. Small-sized foreign matter is attracted to the surface of the mesh, and more foreign matter can be accommodated therein because of spatial linkage. Therefore, the melamine foam is useful as a cleaning member for the electro-photographic image forming apparatuses.

However, in the melamine resin foam that foams the melamine foam, a large spherical cell having a diameter of about a few millimeters (mm) is produced in some rare cases. It is called "pinhole". The portion where the pinhole is present does not naturally contact a member to be cleaned, and therefore, the melamine foam having the pinhole does not serve the function of cleaning. It is therefore regarded that the melamine foam is not suitable for the cleaning member, and is abandoned. When the cleaning member is to be formed, a portion is cut out into a required size from a large block of melamine resin foam, is bonded to a support by an adhesive, and then cutting and polishing are performed thereon for finishing. Thus, the presence of the pinhole in the contact plane of the cleaning member can not be determined before cutting and polishing. Moreover, abandoning the cleaning member results in a big demerit of cost.

The melamine resin foam thus foamed has fluctuations in a foaming factor, and therefore, there are many pinholes on the surface thereof, each having a diameter of about 1 to 3 mm. Moreover, when the foam is cut and formed as the cleaning member, there are pinholes larger than these. A hole having a diameter of 3 mm or more can be checked based on whether the foam with the hole is a qualified component. However, there are many pinholes having a diameter of about 1 to 3 mm. If these foams are determined as faulty components, yield is reduced significantly. It is thus impossible to obtain non-defective components (it is quite clear if you look at the surface of a sponge for household use made of the melamine resin foam).

The presence of the pinholes reduces a contact area with a target cleaning member, and partial reduction in cleaning capability results in nonuniform charging and nonuniform transfer. Particularly, the nonuniform charging and nonuniform transfer result in uneven color in color electro-photography, which is a vital defect.

SUMMARY OF THE INVENTION

It is an object of the present invention to solve at least the problems in the conventional technology.

A cleaning member according to an aspect of the present invention includes a contact portion that is in contact with a cleaning target, at least the contact portion is made of melamine resin foam that is obtained by heating and compressing an original form.

A cleaning device according to another aspect of the present invention includes a cleaning member including a contact portion that is in contact with a cleaning target, at least the contact portion is made of melamine resin foam that is obtained by heating and compressing an original form, wherein the cleaning device is used as a cleaning unit for at least one of an image carrier, a charging member, and a transfer member of an image forming apparatus.

A charging device according to still another aspect of the present invention includes a charging member that is based on any one of a non-contact charging system and a proximity charging system, wherein the charging member charges an image carrier, and a cleaning unit for the charging member includes a cleaning device that includes a cleaning member having a contact portion that is in contact with a cleaning target, at least the contact portion is made of melamine resin foam that is obtained by heating and compressing an original form.

A transfer device according to still another aspect of the present invention includes a transfer member that transfers an image on an image carrier to a transfer material, wherein a cleaning unit for the transfer member includes a cleaning device that includes a cleaning member having a contact portion that is in contact with a cleaning target, at least the contact portion is made of melamine resin foam that is obtained by heating and compressing an original form.

An image forming apparatus according to still another aspect of the present invention includes an image carrier; a charging unit that charges the image carrier; a latent image forming unit that forms an electrostatic latent image on the image carrier charged; a developing unit that develops the electrostatic latent image formed on the image carrier to obtain a visible image thereon; a transfer unit that transfers the visible image to a transfer material; and a cleaning unit that cleans the image carrier after the visible image is transferred to the transfer material, wherein at least one of a cleaning unit for the image carrier, a cleaning unit that cleans the charging member of the charging unit, and a cleaning unit that cleans the transfer member of the transfer device, wherein the cleaning unit includes a cleaning device including a cleaning member having a contact portion that is in contact with a cleaning target, at least the contact portion is made of melamine resin foam that is obtained by heating and compressing an original form.

A process cartridge according to still another aspect of the present invention is provided in an image forming apparatus. The process cartridge includes an image carrier, and at least one of a charging unit, a developing unit, and a cleaning unit integrated into one unit to be detachably attached to the image forming apparatus, the image forming apparatus including the image carrier; the charging unit that charges the image carrier; a latent image forming unit that forms an electrostatic latent image on the image carrier charged; the developing unit that develops the electrostatic latent image formed on the image carrier to obtain a visible image thereon; a transfer unit that transfers the visible image to a transfer material; and the cleaning unit that cleans the image carrier after the visible image is transferred to the transfer material, wherein at least one of the cleaning unit for the image carrier and a cleaning unit that cleans a charging member of the charging unit, includes a cleaning device including a cleaning member having a contact portion that is in contact with a cleaning target, at least the contact portion is made of melamine resin foam that is obtained by heating and compressing an original form.

An image forming apparatus according to still another aspect of the present invention includes a process cartridge, wherein an image carrier and at least one of a charging unit, a developing unit, and a cleaning unit are integrated into one unit to be detachably attached to the image forming apparatus. The charging unit charges the image carrier, a latent image forming unit forms an electrostatic latent image on the image carrier charged, the developing unit develops the electrostatic latent image formed on the image carrier to obtain a visible image thereon, a transfer unit transfers the visible image to a transfer material, and the cleaning unit cleans the image carrier after the visible image is transferred to the transfer material. At least one of the cleaning unit for the image carrier and a cleaning unit that cleans a charging member of the charging unit, includes a cleaning device including a cleaning member having a contact portion that is in contact with a cleaning target, at least the contact portion is made of melamine resin foam that is obtained by heating and compressing an original form.

The other objects, features, and advantages of the present invention are specifically set forth in or will become apparent from the following detailed description of the invention when read in conjunction with the accompanying drawings.

DETAILED DESCRIPTION

Exemplary embodiments of a cleaning member, a cleaning device, a charging device, a transfer device, a process cartridge, and an image forming apparatus according to the present invention are explained in detail below with reference to the accompanying drawings.

Figure 1:
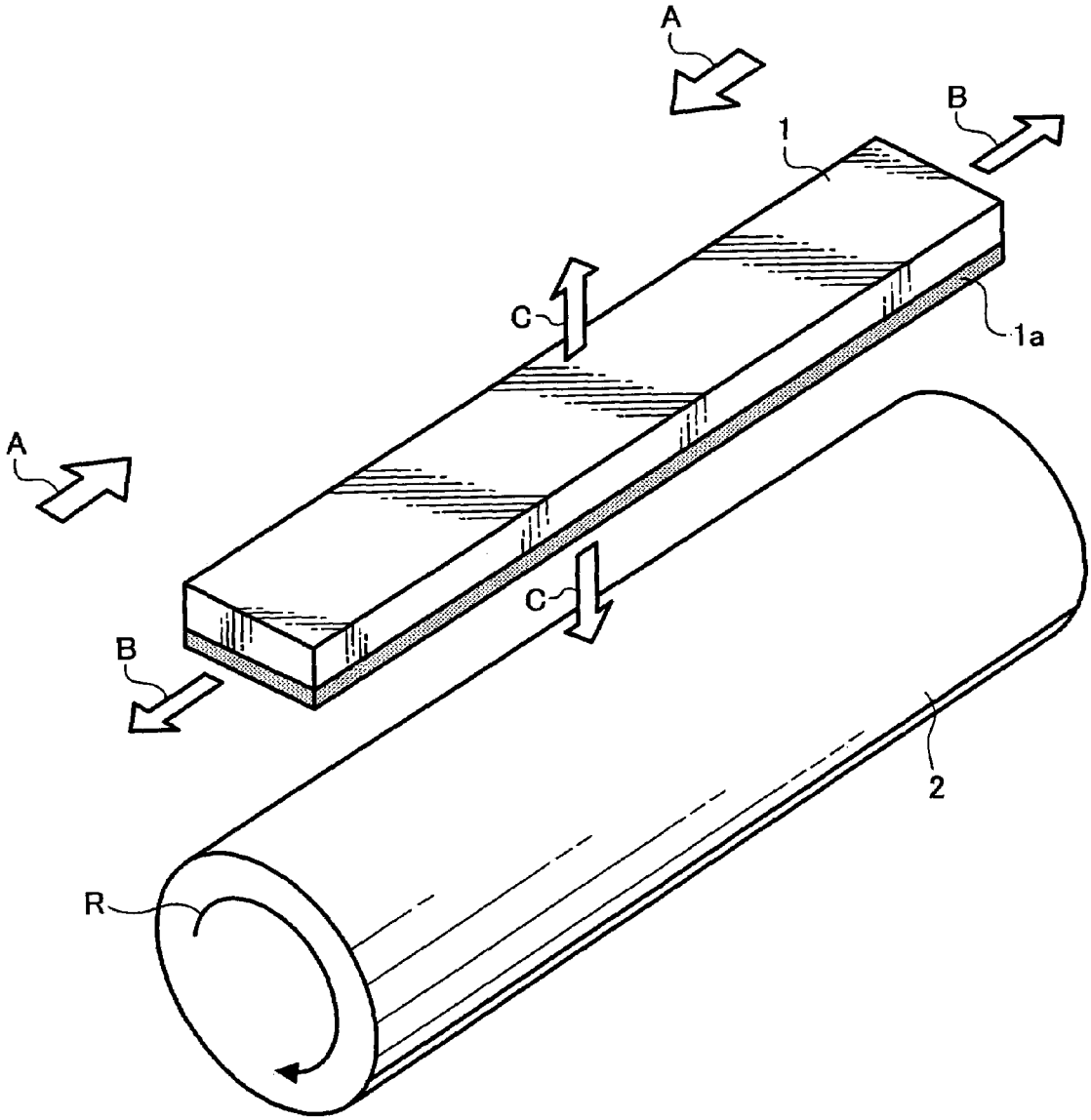
FIG. 1 is a schematic perspective view of a cleaning member and a cleaning target according to the present invention.

FIG. 1 is a schematic perspective view of a cleaning member and a cleaning target according to the present invention.

A cleaning member 1 includes a melamine resin foam 1*a*. The melamine resin foam 1*a* is used in at least a contact portion of the cleaning member 1 that is in contact with a cleaning target 2 or a member to be cleaned 2 (hereinafter, "cleaning target member 2"), and is formed by heating and compressing the melamine foam. Before heating and compression, that is, its original form is a foam having a three-dimensional mesh structure in which cells of some tens to hundreds of micrometers are linked. Small-sized foreign matter is attracted to the surface of the mesh, and more foreign matter can be accommodated therein because of their spatial linkage. Therefore, the melamine foam is a useful material as a member to clean toner used in electrophotographic image forming apparatuses.

However, before heating and compression (i.e., the original form), a large spherical cell (pinhole) having a diameter of about a few millimeters (mm) may be produced in some rare cases. The portion where the pinhole is present does not come into contact with the cleaning target member 2. Therefore, the melamine foam having the pinhole does not serve a function of cleaning. Therefore, such melamine foam is not suitable as the cleaning member. In the present invention, by heating and compressing the melamine foam to obtain the melamine resin foam 1*a*, and by making a pinhole having a diameter of a few mm oval and smaller, a contact area between the melamine resin foam 1*a* and the cleaning target member 2 increases.

If compressibility of heating and compression is 30% or lower, the melamine foam is difficult to get deformed. If kept at high temperature and at high humidity, the melamine foam expands, which makes it difficult to keep the precision thereof. Influence of this is significant when devices are transported by ship, or when devices are piled in the bottom of a ship and transported through the tropical zone on the equator. Furthermore, if the compressibility is 70% or higher, spatial linkage of the cells narrows, and foreign matter cannot be fully accommodated therein. Therefore, the cleaning function cannot be exhibited sufficiently. Hence, the compressibility is preferably from 30% to 70%.

Figure 2A:
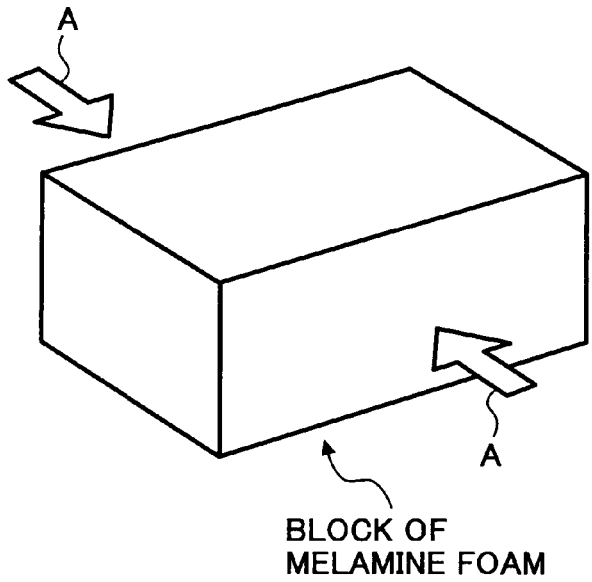
FIG. 2A illustrates a compression direction of a melamine foam.
Figure 2B:
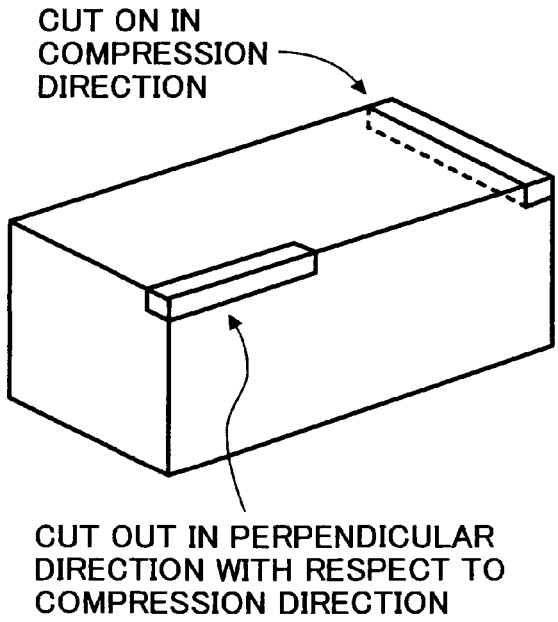
FIG. 2B illustrates a direction of cutting out a portion therefrom after compression.

FIG. 2A and FIG. 2B illustrate a compression direction of a melamine foam and a direction of cutting out a portion therefrom after compression. FIG. 2A depicts a block of the melamine foam, and an arrow A herein represents the compression direction. As shown in FIG. 2B, the direction of cutting out the portion from the melamine foam includes a first direction of cutting it out in the compression direction and a second direction of cutting it out perpendicular to the compression direction.

Figure 3A:
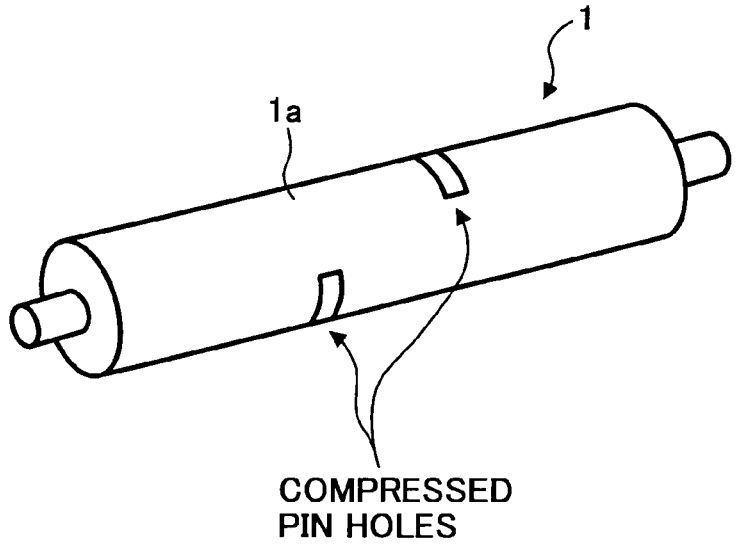
FIG. 3A and FIG. 3B illustrate shapes of pinholes and a contact area with a member to be cleaned, when a melamine resin foam is formed with a portion cut out from the melamine foam in the compression direction, and is used for a roller-shaped cleaning member.
Figure 3B:
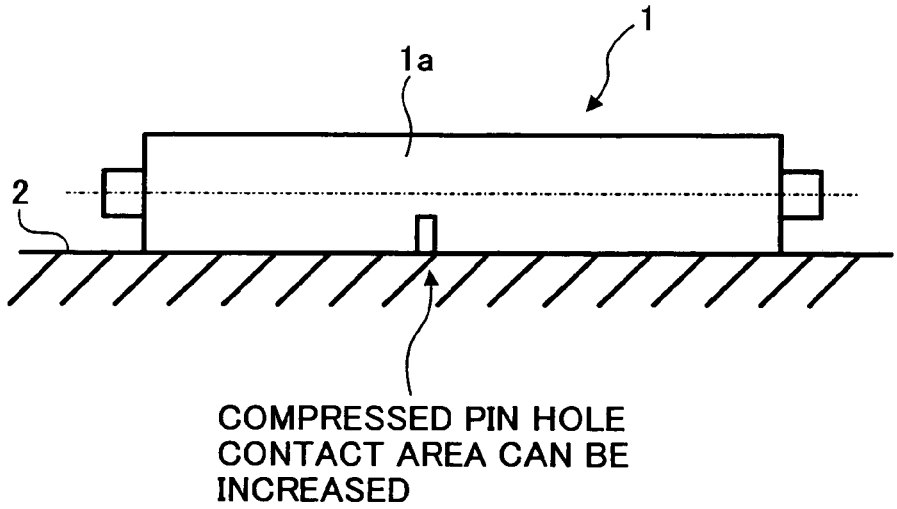

As an example, a portion of the melamine foam is cut out in the compression direction as the first direction to form the melamine resin foam 1*a*. When the melamine resin foam 1*a* is used for the roller-shaped cleaning member as shown in FIG. 3A, by making the compression direction coincide with the axial direction of the cleaning member 1, oval pinholes appearing over the surface are compressed in the axial direction. Therefore, all the pinholes have their longitudinal directions in the circumferential direction of the cleaning member 1. Therefore, as shown in FIG. 3B, the contact area between the melamine resin foam 1*a* and the cleaning target member 2 can be increased, and therefore, cleaning capability improves.

Figure 4A:
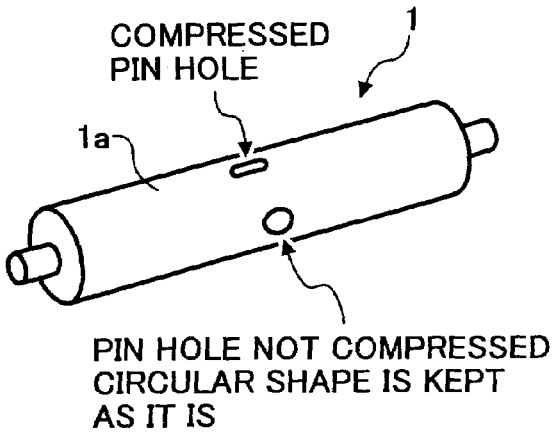
FIG. 4A to FIG. 4D illustrate the shapes of pinholes and a contact area with the member to be cleaned, when a melamine resin foam is formed with a portion cut out from the melamine foam in the vertical direction with respect to the compression direction, and is used for a roller-shaped cleaning member.
Figure 4B:
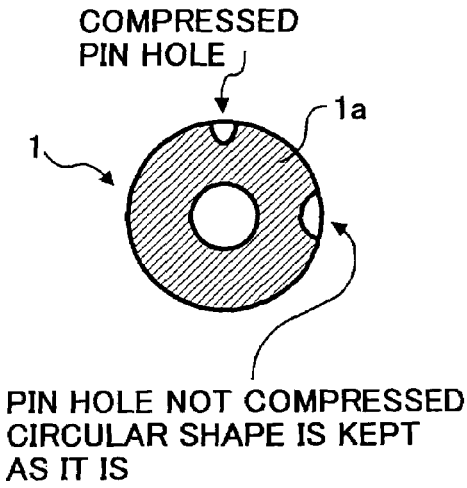
Figure 4C:
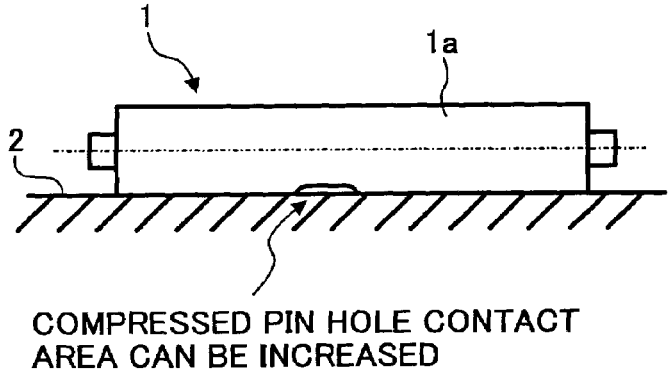
Figure 4D:
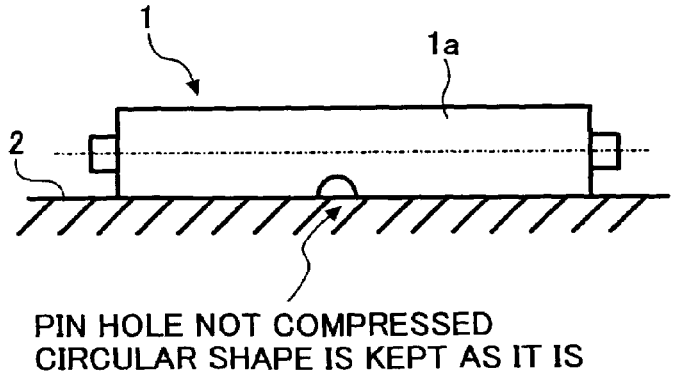

Alternatively, a portion of the melamine foam after compression may be cut out therefrom in the direction perpendicular to the compression direction as the second direction, and may form the melamine resin foam 1*a*. In such case, when the cleaning member 1 is formed as a roller as shown in FIG. 4A and FIG. 4B, the oval shapes of pinholes are different from each other depending on the position along the circumferential surface of the cleaning member 1. For example, one of the pinholes is compressed in the circumferential direction, and another one is not compressed and the circular shape thereof is kept as it is. However, the contact area between the melamine resin foam 1*a* and the cleaning target member 2 can be increased. As for a pinhole on the melamine resin foam 1*a* in the compression direction, the cross section of the pinhole is oval but the surface thereof is circular, and the depth thereof is narrow. Therefore, by pushing the cleaning member 1 against the cleaning target member 2, the contact area can be increased, which allows better cleaning capability.

Figure 5:
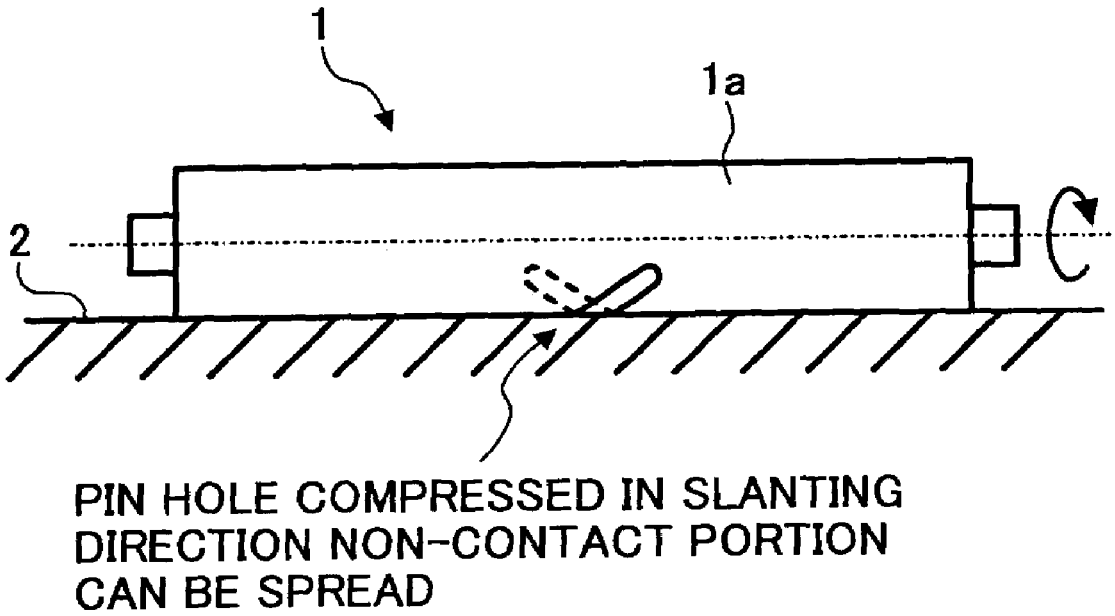
FIG. 5 illustrates the shape of a pinhole and a contact area with the member to be cleaned, when a melamine resin foam is formed with a portion cut out from the melamine foam in a slanting direction with respect to the compression direction, and is used for a roller-shaped cleaning member.

As another method, there is a third direction. That is, a block of the melamine foam is compressed in a slanting direction, or a portion is cut out from the block in the slanting direction to form the melamine resin foam 1*a*. In other words, all the oval pinholes appearing over the surface of the melamine resin foam 1*a* are slanted. As shown in FIG. 5, if the roller-shaped cleaning member 1 or the cleaning target member 2 moves, a portion of the pinhole in contact with the cleaning target member 2 can be spread, which allows better cleaning capability.

As explained above, the low yield due to pinholes is improved and a high quality cleaning member can be provided.

As an example, as shown in FIG. 1, the melamine resin foam 1*a* of the cleaning member 1 is heated and compressed to a size of 70% to 30% of its original form (e.g., the size is compressed to 7/10 to 3/10). In other words, the melamine foam is compressed at a compressibility of 7/10 to 3/10 in a longitudinal direction of the cleaning target member 2. Specifically, the longitudinal direction is approximately perpendicular to a movement direction R of the cleaning target member 2, and the compression is carried out in the compression direction as indicated by arrow A. The compressed melamine foam is formed into a desired shape of the cleaning member, that is, a pad shape or a roller shape.

The reason that the melamine foam is compressed in the longitudinal direction (which is the direction approximately perpendicular to the movement direction R of the cleaning target member 2) of the cleaning target member 2 is as follows. That is because if the cleaning member is of roller shape, the direction of compression becomes nonuniform in the cross section of the roll when it is compressed in a direction other than the longitudinal direction. When the cleaning member is formed in the pad shape, the compression direction may be changed to a direction in which the cleaning member can be used. Therefore, when the cleaning member is of the roller shape, the compression direction of the melamine resin foam may be approximately perpendicular to a movement direction of the cleaning target member. When it is the pad shape, the compression direction may be at a predetermined angle with respect to the movement direction of the cleaning target member.

The cleaning member 1 of the present invention is preferably used in a cleaning device that cleans at least one of the cleaning target members 2 such as the image carrier, the charging member, and the transfer member. The charging member to be cleaned by the cleaning member 1 is mainly a charge roller, and the transfer member is mainly a transfer roller.

The shape of the cleaning member of the present invention is not particularly limited, and therefore, the cleaning member can be used in a various shape such as the roller shape other than the pad shape as shown in FIG. 1. The whole of the cleaning member may be formed with the melamine resin foam, but as shown in FIG. 1, only a portion 1*a* of the cleaning member that is in contact with the cleaning target member 2 is formed with the melamine resin foam.

The cleaning member 1 is in contact with the cleaning target member 2. At this time, the cleaning member 1 may be pushed against the cleaning target member 2 by the weight of the cleaning member 1. In other words, if the cleaning member 1 is brought into contact with the cleaning target member 2 by pressure using a spring or the like, the cleaning capability is improved. However, in such case, the wearing out of the cleaning target member 2 increases, which reduces the life. Therefore, by causing the cleaning member 1 to be pushed against the cleaning target member 2 by the weight of the cleaning member 1, the maintenance of the cleaning capability and the increase in life of the cleaning member can be compatible with each other.

When formed in the roller shape, the cleaning member 1 may be pushed against the cleaning target member 2 by the weight of the cleaning member 1, and rotate following the movement of the cleaning target member 2 (e.g., rotation in the direction of arrow R in FIG. 1).

The cleaning member 1 of the present invention may be arranged so as to come in contact with and separate from the cleaning target member 2 such as the image carrier, the charging member, and the transfer member in the directions of arrow C shown in FIG. 1. In other words, when the image forming apparatus is stopped, the cleaning member 1 may be separated from the cleaning target member 2. This results in an increase in life of the cleaning target member 2. Therefore, it is preferable to arrange the cleaning member 1 so as to freely contact and separate from the cleaning target member 2. In this case, the cleaning device includes the cleaning member 1 and a contact/separation mechanism (not shown) that supports the cleaning member 1.

Alternatively, the cleaning member 1 of the present invention may be arranged so as to be freely reciprocate in the axial direction of the cleaning target member 2 (directions of arrow B of FIG. 1). In this case, the cleaning device includes the cleaning member 1 and a reciprocating mechanism (not shown) that supports the cleaning member 1.

The charging device according to the present invention includes a charging member (e.g., charge roller) based on a non-contact charging system or proximity charging system, and the charge roller charges the image carrier (e.g., electrophotographic photosensitive element). The charging device also includes a cleaning device using the cleaning member 1 as a cleaning unit for the charge roller. More specifically, the cleaning member 1 is provided in contact with the surface of the charge roller that is the cleaning target member 2. Alternatively, the cleaning member 1 is provided so as to freely contact the surface of the charge roller or separate therefrom. At the time of cleaning, the cleaning member 1 comes in contact with the surface of the charge roller, and rotates along with the charge roller to clean the surface thereof.

The charging device is based on the non-contact or proximity charging system, and the charge roller has a gap holding portion for providing a gap with the image carrier. The gap holding portion is a projection such as a gap tape for providing a gap between the image carrier and the charge roller. Therefore, the cleaning member 1 according to the present invention may be in contact with at least a part of the gap holding portion.

The transfer device according to the present invention includes the transfer member (e.g., transfer roller) that transfers an image on the image carrier to a transfer material, and a cleaning device using the cleaning member 1 as a cleaning unit for the transfer roller. More specifically, the cleaning member 1 is provided in contact with the surface of the transfer roller that is the cleaning target member 2. Alternatively, the cleaning member 1 is provided so as to freely contact the surface of the transfer roller or separate therefrom. At the time of cleaning, the cleaning member 1 comes in contact with the surface of the transfer roller, and rotates along with the transfer roller to clean the surface thereof.

An embodiment of an image forming apparatus with the cleaning member of the present invention used therein is explained below with reference to the accompanying drawings. In this embodiment, the cleaning member is used as a cleaner for the charge roller of the image forming apparatus.

Figure 6:
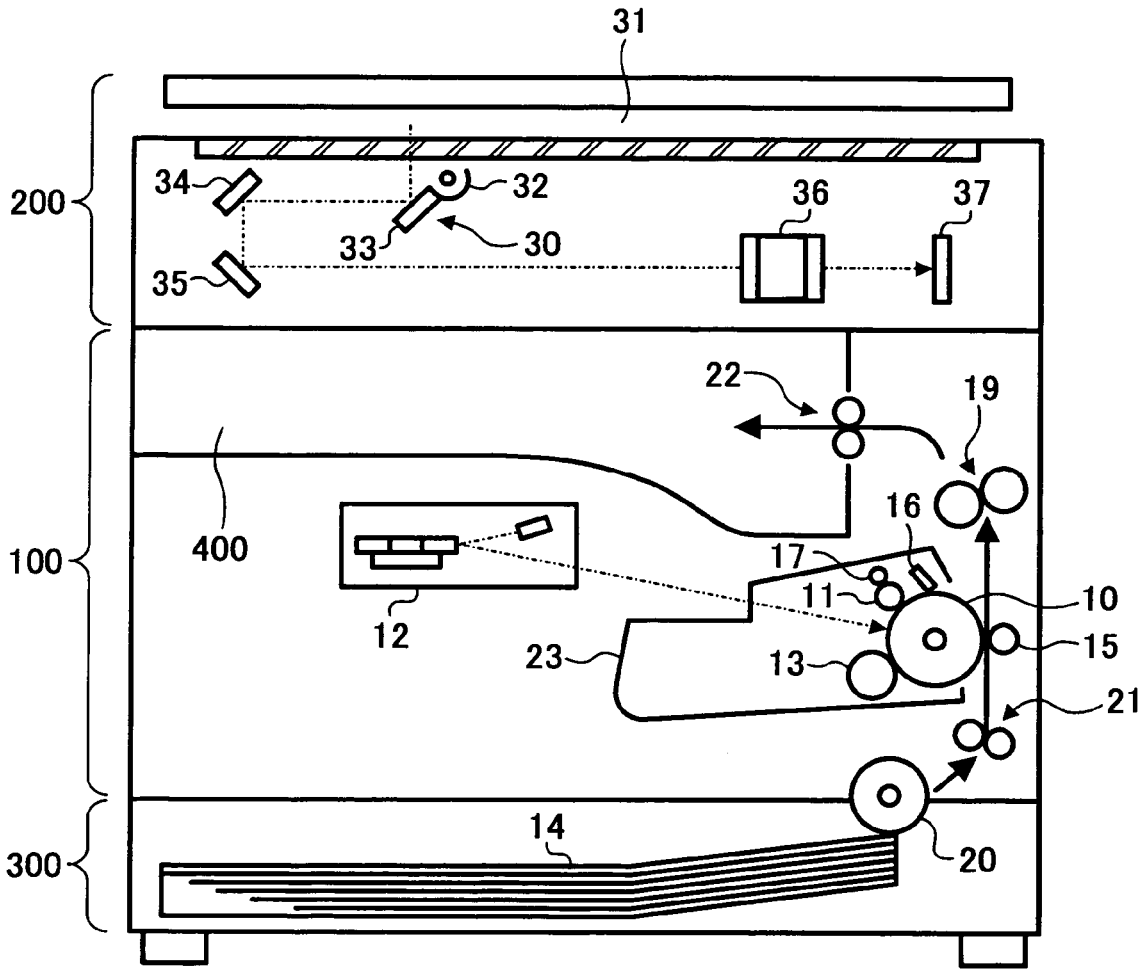
FIG. 6 illustrates an image forming apparatus according to an embodiment of the present invention.

The overall configuration of the image forming apparatus is explained below with reference to FIG. 6. FIG. 6 illustrates an example of an image forming apparatus with a built-in paper discharge mechanism. An imaging unit 100 is arranged at approximately the center thereof, and a paper feed unit 300 is arranged right below the imaging unit 100. Another paper feed device may be arranged under the paper feed unit 300, if necessary. A reader 200 that reads a document is arranged above the imaging unit 100. Between the imaging unit 100 and the reader 200 is the discharged paper stack portion 400 that stacks a discharged paper that is a transfer material (e.g., recording paper) onto which an image is formed.

The imaging unit 100 includes a drum-shaped image carrier 10, a charging device (charge roller) 11, an exposing device 12, a developing device 13, a transfer device (transfer roller) 15, and a cleaning device 16 arranged around the drum-shaped image carrier 10. More specifically, the drum-shaped image carrier 10 is an electro-photographic photosensitive element 10 (hereinafter, "photosensitive element 10"), the charging device 11 charges the surface of the photosensitive element 10. The exposing device 12 emits a laser beam indicating image information to the surface of the photosensitive element 10, to form an electrostatic latent image thereon. The developing device 13 visualizes the electrostatic latent image formed, to obtain a toner image. The transfer device 15 transfers the toner image to a sheet of paper. The cleaning device 16 removes toner remaining on the surface of the photosensitive element 10 after the toner image is transferred, and recovers the toner removed. The cleaning device 16 of the present invention is biased, and is in contact with the charging device 11.

In recent years, the photosensitive element 10, the charging device 11, the developing device 13, and the cleaning device 16 are integrated into one unit as a process cartridge 23, for easy maintenance. A fixing device 19 that fixes toner on the paper with the toner image is arranged on the downstream in a paper conveying path. The paper passing through the fixing device 19 passes through paper discharge rollers 22 to be discharged and stacked in the discharged paper stack portion 400.

Unused transfer material (recording paper) 14 is stored in the paper feed unit 300. The topmost paper is sent out from a paper feed cassette by rotation of a paper feed roller 20, and is conveyed to registration rollers 21. The registration rollers 21 temporarily stop the paper being conveyed, and start rotation at a timing of control so that a position of a toner image on the surface of the photosensitive element 10 and a position of the front edge of the paper reach predetermined positions.

In the reader 200, a scanning element 30 reciprocates to scan a document (not shown) placed on a contact glass 31. The scanning element 30 includes a light source 32 for illuminating the document and mirrors 33 to 35. Information for an image scanned by the scanning element 30 is read as an image signal in an imaging element 37 such as a charge-coupled device (CCD) disposed on the rear side of an imaging lens 36. The image signal read is digitized, and is subjected to image processing. Based on the image-processed signal, a laser diode (not shown) of the exposing device 12 emits light to the surface of the photosensitive element 10, and forms an electrostatic latent image thereon. A light signal from the laser diode passes through known polygon mirror and lenses to reach the photosensitive element 10 for exposure.

An embodiment in which the cleaning device is used as a cleaner for a charge roller of the process cartridge 23 of the image forming apparatus as shown in FIG. 6 is explained below with reference to FIG. 7. The cleaning device includes a cleaning roller using the melamine resin foam of the present invention.

A core metal having a diameter ϕ of 4 mm is covered with the melamine resin foam with a predetermined thickness using an adhesive, to form a cleaning roller 17 having a diameter ϕ of 8.5 millimeters. Bearings (not shown) are fitted into journal portions at both ends of the cleaning roller 17. Fixed to the bearing is a compression spring 24, and an opposite side of the compression spring 24 is fixed to a housing portion of the process cartridge 23 so as to be supported. The cleaning roller 17 is biased to the non-contact type charge roller 11 by the compression spring 24.

As explained above, the cleaning device including the cleaning roller 17 is used in the process cartridge 23 to improve the cleaning capability of the charge roller 11. This largely contributes to increased life of the process cartridge 23.

Figure 8:
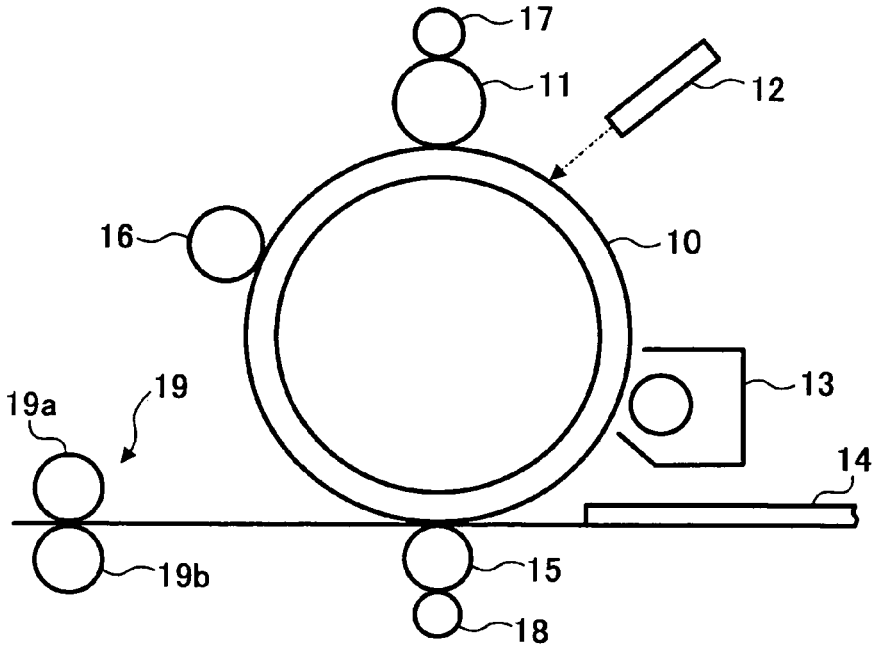
FIG. 8 illustrates an imaging unit of the image forming apparatus.

A more specific configuration of the image forming apparatus including the cleaning member of the present invention is explained below with reference to FIG. 8. FIG. 8 illustrates only the imaging unit of the image forming apparatus. The imaging unit includes the image carrier 10 such as an electro-photographic photosensitive element, and the charge roller 11 of a contact charging type charging device that charges the image carrier 10. The imaging unit also includes the exposing device (laser exposing optical system) 12 that is a latent image forming unit that radiates a laser beam to the charged image carrier 10, and forms an electrostatic latent image thereon. The imaging unit further includes the developing device 13 using a developer (e.g., toner) that develops the electrostatic latent image formed, and visualizes it to obtain a visible image, and the transfer roller 15 of the transfer device that transfers the visible image to the transfer material (recording paper) 14. The imaging unit further includes the cleaning device 16 that cleans the image carrier 10 after the visible image is transferred, and the fixing device 19 that includes a fixing roller pair 19*a* and 19*b* and that fixes an image (toner image) on the transfer material 14.

The cleaning device that includes the cleaning member (e.g., cleaning roller) made of the melamine resin foam is used for at least one of the cleaning device 16 for the image carrier 10, the cleaning device 17 that cleans the charge roller 11, and a cleaning device 18 that cleans the transfer roller 15. The cleaning member is provided so as to be in contact with any of the image carrier 10, the charge roller 11, and the transfer roller 15, or to be freely in contact with or separate from it. The place in which the cleaning member is provided is not limited to the example. The cleaning member is provided so as to clean at least one of the image carrier 10, the charge roller 11, and the transfer roller 15.

Figure 7:
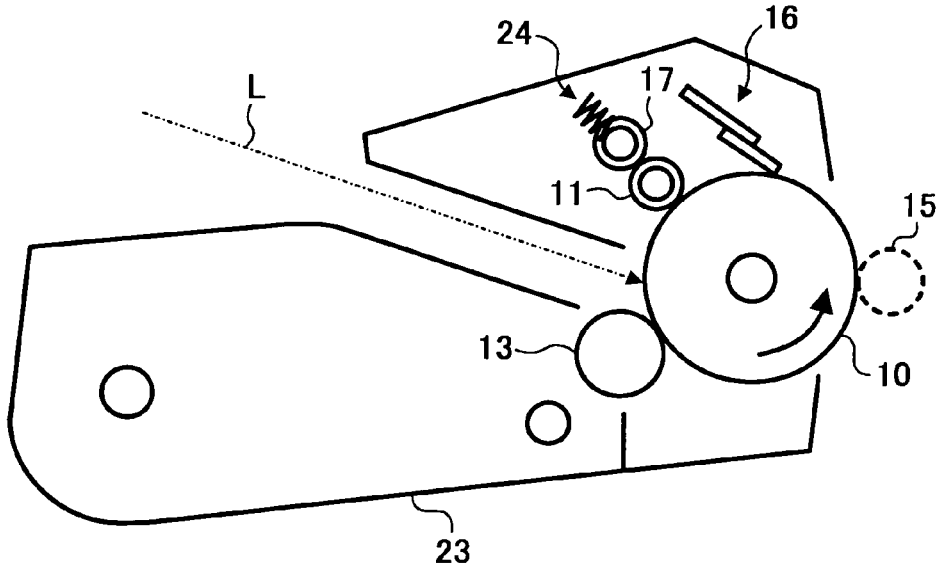
FIG. 7 is a schematic cross section of a process cartridge to be mounted on the image forming apparatus shown in FIG. 6.

In the image forming apparatus configured as shown in FIG. 8, the image carrier 10 and at least one of the charge roller 11, the developing device 13, and the cleaning device 16 may be integrated into one unit as a process cartridge, as shown in FIG. 7. The process cartridge is detachably attached to the image forming apparatus. In such case, the cleaning device for the image carrier 10 and the cleaning device that cleans the charge roller 11 are integrally incorporated in the process cartridge.

As explained above, at least one of the charging device, the developing device, and the cleaning device and the image carrier are integrated into one unit as a process cartridge. The process cartridge is detachably attached to the image forming apparatus, which allows easy maintenance. In case of any failure caused by the components or the devices, quick recovery to the normal state is possible by simply replacing the process cartridge with another one, thereby reducing service time.

When the charging device, the image carrier, and the cleaning device are integrated into one unit as a process cartridge, the cleaning device including the cleaning member is used in the process cartridge, and the cleaning capability of the image carrier and the charging member is thereby improved. This largely contributes to increased life of the process cartridge.

In the process cartridge and the image forming apparatus, the cleaning capability can be largely improved by using the cleaning device including the cleaning member. Therefore, polymer toner can be used as a developer for the developing device.

A specific example of the present invention is explained next. A layer made of a melamine resin foam (produced by BASF Corp. Product name: Basotect) was heated and compressed, and bonded by an adhesive to an outer peripheral surface of a core metal having a diameter ϕ of 5 mm. The melamine resin foam has a three-dimensional mesh structure in which cells each of some tens to hundreds of microns are linked. The layer bonded was polished through rotation, and formed to have a thickness of 1.75 mm. From this, a roller shaped cleaning member (cleaning roller) having an outer diameter of 8.5 mm was produced.

As shown in FIG. 8, the cleaning roller thus produced was used in the cleaning device 16 for the image carrier (photosensitive element) 10, and the cleaning device 17 for the charge roller 11. The cleaning rollers 16 and 17 were fixed to be in contact with the image carrier 10 and the charge roller 11, respectively, by the weight of the cleaning rollers 16 and 17, or be in the state in which the cleaning rollers 16 and 17 are pushed against the image carrier 10 and the charge roller 11, respectively, by a compression spring or the like. Thus, the cleaning rollers 16 and 17 were made to rotate along with rotation of the image carrier 10 and the charge roller 11, respectively.

Image output testing of 40,000 sheets was conducted using the image forming apparatus under the following environments (1) to (3).

(1) High temperature/High humidity (temperature: 32° C., humidity: 54% RH)

(2) Low temperature/Low humidity (temperature: 10° C., humidity: 15% RH)

(3) Standard Environment (temperature: 23° C., humidity: 50% RH)

At that time, bias applied to the charge roller 11 of the charging device included alternating current (ac) bias +direct current (dc) bias. The bias was adjusted to voltages at which the image carrier 10 was stably charged, and then applied.

The non-contact charging system was used for the charge roller 11. This system was used to provide a gap of about 50 micrometers between the charge roller 11 and the image carrier 10 using a gap holding member (not shown).

The polymer toner was used for the developer.

As a result of the image output testing, no trouble occurred in the initial image and the 40,000-th image under the environments (1) to (3). Furthermore, no abnormality such as a flaw or a pinhole was observed in the image carrier 10 and the charge roller 11.

The melamine resin foam that underwent the image output testing was dyed with color of toner, which indicates that the toner as a main cause of soil can be efficiently taken into the foam.

As a comparative example 1, an image output testing was conducted under the conditions that the melamine resin foam was not straight enough, and the melamine resin foam was not in contact with the charge roller along the whole circumference. Consequently, on the contrary to the example, the image was soiled because of nonuniform charging.

As a comparative example 2, an image output testing was conducted under the conditions that a brush with nylon fibers was in contact with the image carrier. The nylon fibers are another cleaning member for the charge roller, and are electrostatically planted to obtain the brush. Consequently, the image was soiled because of nonuniform charging.

The cleaning member according to the present invention has an overwhelmingly different point from the other cleaning members as explained next. After the testing was finished, soil was slightly present on the melamine resin foam of the present invention. Whereas, when the other materials were used, the surface of the charge roller was filmed and adherents were present on the film of the surface.

In other words, in the cleaning member according to the present invention, not filming the surface layer of the cleaning target member enables to maintain excellent cleaning capability.

As explained in the comparative example 1, the straightness of cleaning member was poor (the roller mounted had a warp of about 0.5 mm) and the cleaning member was kept separated from the cleaning target in many regions, which reduced the cleaning capability. The same goes for presence of the pinhole. As explained in the present invention, the melamine resin foam is heated and compressed, and the presence of the pinhole is made thereby unnoticeable, which optimizes the cleaning capability. Therefore, it is appropriate to set the heating and compression of the melamine resin foam to a range from the minimum 7/10 to the maximum 3/10.

As explained above, according to the present invention, using the melamine resin foam heated and compressed suppresses the wearing out of the cleaning target such as the image carrier, the charging member, and the transfer member. Therefore, it is possible to realize the cleaning member capable of maintaining the performance of the cleaning target at the adequate state for a long period of time, and to provide the cleaning device using the cleaning member. It is also possible to provide the charging device, the transfer device, the process cartridge, and the image forming apparatus with improved life, achieved by using the cleaning device including the cleaning member.

According to the present invention, using the melamine resin foam obtained by heating and compressing the original form increases the contact area with the cleaning target, and maintains the performance of the cleaning target at the adequate state for a long period of time. Therefore, the wearing out of the cleaning target such as the image carrier, the charging member, and the transfer member is suppressed. It is therefore possible to realize the cleaning member capable of maintaining the performance of the cleaning target at the adequate state for a long period of time and to provide the cleaning device using the cleaning member. It is also possible to provide the charging device, the transfer device, the process cartridge, and the image forming apparatus with improved life, achieved by using the cleaning device including the cleaning member.

Furthermore, at least one of the charging unit, the developing unit, and the cleaning unit and the image carrier are integrated into one unit as a process cartridge, and the process cartridge is detachably attached to the body of the image forming apparatus to allow its easy maintenance. In case of any failure caused by the components or the devices, by simply replacing the process cartridge with another one, the current state can be quickly recovered to the normal state, which reduces service time. Moreover, the cleaning device including the cleaning member is used in the process cartridge, and the cleaning capability of the image carrier and the charging member thereby improves. This largely contributes to increased life of the process cartridge.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A charging device comprising:

a charging member that is based on any one of a non-contact charging system and a proximity charging system, wherein the charging member comprises a cleaning target that moves in a predetermined direction and charges an image carrier, and a cleaning unit for the charging member, wherein the cleaning unit includes a cleaning device that includes a roller shaped cleaning member having a roller surface comprising a contact portion that is in contact with the cleaning target, wherein at least the contact portion is made of melamine resin foam that is obtained by heating and compressing an original form in a compression direction that is approximately along the axial direction of the roller shaped cleaning member parallel to the roller surface and perpendicular to a movement direction of the cleaning target.

2. The charging device according to claim 1, wherein the melamine resin foam is formed by cutting out a predetermined portion from the original form after heating and compressing the original form.

3. The charging device according to claim 1, wherein the melamine resin foam is heated and compressed to a size of from 70% to 30% of the original form.

4. A transfer device comprising:

a transfer member that comprises a cleaning target that moves in a predetermined direction and transfers an image on an image carrier to a transfer material, wherein a cleaning unit for the transfer member includes a cleaning device that includes a roller shaped cleaning member having a roller surface comprising a contact portion that is in contact with the cleaning target, wherein at least the contact portion is made of melamine resin foam that is obtained by heating and compressing an original form in a compression direction that is approximately along the axial direction of the roller shaped cleaning member parallel to the roller surface and perpendicular to a movement direction of the cleaning target.

5. The transfer device according to claim 4, wherein the melamine resin foam is formed by cutting out a predetermined portion from the original form after heating and compressing the original form.

6. The transfer device according to claim 4, wherein the melamine resin foam is heated and compressed to a size of from 70% to 30% of the original form.

7. An image forming apparatus comprising:

an image carrier;

a charging unit that charges the image carrier;

a latent image forming unit that forms an electrostatic latent image on the charged image carrier;

a developing unit that develops the electrostatic latent image formed on the image carrier to obtain a visible image thereon;

a transfer unit that transfers the visible image to a transfer material, wherein at least one of the image carrier, the charging unit and the transfer unit comprises a cleaning target that moves in a predetermined direction; and a cleaning unit that cleans the image carrier after the visible image is transferred to the transfer material, a cleaning unit that cleans a charging member of the charging unit and a cleaning unit that cleans the transfer member of the transfer unit, wherein at least one of the cleaning unit for the image carrier, the cleaning unit that cleans the charging member of the charging unit, and the cleaning unit that cleans the transfer member of the transfer unit includes a cleaning device including a roller shaped cleaning member having a roller surface comprising a contact portion that is in contact with the respective cleaning target, wherein at least the contact portion is made of melamine resin foam that is obtained by heating and compressing an original form in a compression direction that is approximately along the axial direction of the roller shaped cleaning member parallel to the roller surface and perpendicular to a movement direction of the cleaning target.

8. The image forming apparatus according to claim 7, wherein polymer toner is used as a developer for the developing unit.

9. The image forming apparatus according to claim 7, wherein the melamine resin foam is formed by cutting out a predetermined portion from the original form after heating and compressing the original form.

10. The image forming apparatus according to claim 7, wherein the melamine resin foam is heated and compressed to a size of from 70% to 30% of the original form.

11. A process cartridge provided in an image forming apparatus, comprising:

an image carrier, and at least one of a charging unit, a developing unit, and a cleaning unit integrated into one unit to be detachably attached to the image forming apparatus, the image forming apparatus including the image carrier;

the charging unit that charges the image carrier, wherein at least one of the image carrier and the charging unit comprises a cleaning target that moves in a predetermined direction;

a latent image forming unit that forms an electrostatic latent image on the charged image carrier;

the developing unit that develops the electrostatic latent image formed on the image carrier to obtain a visible image thereon;

a transfer unit that transfers the visible image to a transfer material;

the cleaning unit that cleans the image carrier after the visible image is transferred to the transfer material, and a cleaning unit that cleans a charging member of the charging unit, wherein at least one of the cleaning unit for the image carrier and the cleaning unit that cleans the charging member of the charging unit, includes a cleaning device including a roller shaped cleaning member having a roller surface comprising a contact portion that is in contact with the respective cleaning target, wherein at least the contact portion is made of melamine resin foam that is obtained by heating and compressing an original form in a compression direction that is approximately along the axial direction of the roller shaped cleaning member parallel to the roller surface and perpendicular to a movement direction of the cleaning target.

12. The process cartridge according to claim 11, wherein polymer toner is used as a developer for the developing unit.

13. The process cartridge according to claim 11, wherein the melamine resin foam is formed by cutting out a predetermined portion from the original form after heating and compressing the original form.

14. The process cartridge according to claim 11, wherein the melamine resin foam is heated and compressed to a size of from 70% to 30% of the original form.

15. An image forming apparatus comprising:

a process cartridge, wherein an image carrier and at least one of a charging unit, a developing unit, and a cleaning unit are integrated into one unit to be detachably attached to the image forming apparatus, wherein the charging unit charges the image carrier, wherein at least one of the image carrier and the charging unit comprises a cleaning target that moves in a predetermined direction, a latent image forming unit forms an electrostatic latent image on the charged image carrier, the developing unit develops the electrostatic latent image formed on the image carrier to obtain a visible image thereon, a transfer unit transfers the visible image to a transfer material, the cleaning unit cleans the image carrier after the visible image is transferred to the transfer material, and a cleaning unit that cleans a charging member of the charging unit, wherein at least one of the cleaning unit for the image carrier and the cleaning unit that cleans the charging member of the charging unit, includes a cleaning device including a roller shaped cleaning member having a roller surface comprising a contact portion that is in contact with the respective cleaning target, wherein at least the contact portion is made of melamine resin foam that is obtained by heating and compressing an original form in a compression direction that is approximately along the axial direction of the roller shaped cleaning member parallel to the roller surface and perpendicular to a movement direction of the cleaning target.

16. The image forming apparatus according to claim 15, wherein the melamine resin foam is formed by cutting out a predetermined portion from the original form after heating and compressing the original form.

17. The image forming apparatus according to claim 15, wherein the melamine resin foam is heated and compressed to a size of from 70% to 30% of the original form.

18. A charging device comprising:

a charging roller, and a cleaning roller comprising a contact portion that is in contact with the charging roller, wherein at least the contact portion is made of melamine resin foam that is obtained by heating and compressing an original form in a compression direction that coincides with the axial direction of the cleaning roller.

19. The charging device according to claim 18, wherein the melamine resin foam is heated and compressed to a size of from 70% to 30% of the original form.

20. The charging device according to claim 18, wherein the weight of the cleaning roller pushes the cleaning roller against the charging roller.

21. The charging device according to claim 18, wherein the cleaning roller rotates along with the charging roller.

22. The charging device according to claim 18, wherein the cleaning roller is arranged to come into contact with, and separate from, the charging roller.

23. A cleaning roller comprising:

a contact portion that is in contact with a cleaning target, wherein the contact portion is made of melamine resin foam that is obtained by heating and compressing an original form in a compression direction that coincides with the axial direction of the rotating cleaning roller.

24. A cleaning member comprising:

a contact portion that is in contact with a cleaning target, wherein the contact portion is made of melamine resin foam that is obtained by heating and compressing an original form, wherein the cleaning member has a surface of contact with the cleaning target, which surface is parallel to a direction in which the melamine foam is compressed.

* * * * *